US010835003B1

(12) United States Patent
Clarke et al.

(10) Patent No.: US 10,835,003 B1
(45) Date of Patent: Nov. 17, 2020

(54) INDIRECT LIGHTING ASSEMBLY FOR A SHADE STRUCTURE

(71) Applicants: Dougan H. Clarke, Miami, FL (US); Javier Carbi, Miami, FL (US)

(72) Inventors: Dougan H. Clarke, Miami, FL (US); Javier Carbi, Miami, FL (US)

( * ) Notice: Subject to any disclaimer, the term of this patent is extended or adjusted under 35 U.S.C. 154(b) by 0 days.

(21) Appl. No.: 16/175,120

(22) Filed: Oct. 30, 2018

Related U.S. Application Data

(60) Provisional application No. 62/578,958, filed on Oct. 30, 2017.

(51) Int. Cl.

| | |
|---|---|
| ***A45B 3/02*** | (2006.01) |
| ***A63B 15/02*** | (2006.01) |
| ***A45B 3/04*** | (2006.01) |
| ***A45B 25/06*** | (2006.01) |
| ***A45B 25/02*** | (2006.01) |
| ***A45B 25/14*** | (2006.01) |

(52) U.S. Cl.
CPC ..... *A45B 3/04* (2013.01); *A45B 25/02* (2013.01); *A45B 25/06* (2013.01); *A45B 25/14* (2013.01)

(58) Field of Classification Search
CPC ..... A45B 3/00–04; A45B 25/02–30
USPC ..... 362/102, 127
See application file for complete search history.

(56) References Cited

U.S. PATENT DOCUMENTS

| | | | | |
|---|---|---|---|---|
| 3,313,929 | A | 4/1967 | Schiavone | |
| 4,174,532 | A | 11/1979 | Kelley | |
| 4,225,909 | A | 9/1980 | Scholz et al. | |
| 6,682,204 | B2 | 1/2004 | Mullally et al. | |
| 7,134,762 | B2 | 11/2006 | Ma | |
| 7,331,684 | B2 | 2/2008 | Tung | |
| 7,401,936 | B1 * | 7/2008 | Fan | A45B 3/04 362/102 |
| 7,695,153 | B2 | 4/2010 | Tsai | |
| 7,856,996 | B2 | 12/2010 | Ma | |
| 2006/0196532 | A1 * | 9/2006 | Tung | A45B 3/00 135/16 |
| 2007/0211450 | A1 | 9/2007 | You | |
| 2013/0148334 | A1 | 6/2013 | Chen et al. | |

* cited by examiner

*Primary Examiner* — Jason M Han
(74) *Attorney, Agent, or Firm* — Malloy & Malloy, P.L.; Jennie S. Malloy

(57) ABSTRACT

An indirect lighting assembly for a shade structure including a lighting assembly, preferably in the form of an LED array, mounted on a hub of the shade structure and movable therewith concurrent to opening and closing of a canopy of the shade structure. The illumination source is disposed on an inner end of the hub and oriented to direct illumination outwardly therefrom onto an interior surface of the canopy. A control assembly is operatively connected to the lighting assembly in current regulating relation to LED array and comprises touch control switching operative to regulate current flow thereto. The touch control switching includes a touch control member connected to the hub and movable therewith into an overhead, access restricting position concurrent to disposition of the canopy in an open orientation.

20 Claims, 7 Drawing Sheets

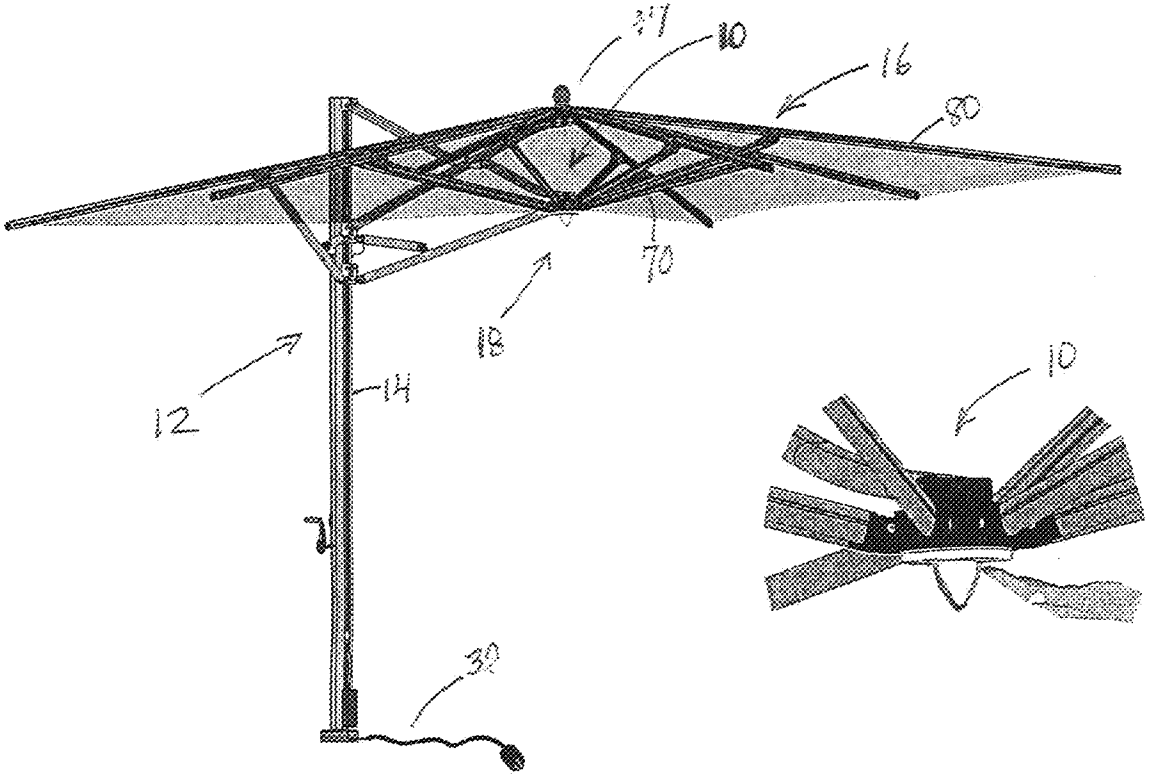
FIGURE 1-A
FIGURE 1-B
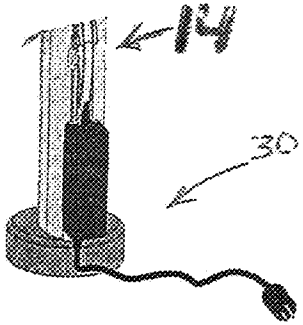
FIGURE 1-C

INDIRECT LIGHTING ASSEMBLY FOR A SHADE STRUCTURE

This Non-Provisional patent application claims priority to a Provisional application, namely, that filed on Oct. 30, 2017 having Ser. No. 62/578,958 which is incorporated by reference here in its entirety.

BACKGROUND OF THE INVENTION

Field of the Invention

The present invention is directed to an indirect lighting assembly for a shade structure specifically including, but not limited to, a large outdoor-type of umbrella. A lighting assembly including an illumination source is mounted on and movable with a hub of the shade structure, wherein the illumination source is oriented to direct lighting upwardly and onto the interior of the canopy of the shade structure, when the canopy is in an open orientation. In one or more embodiments, the lighting assembly can be activated and de-activated by simple touch control, and further, includes features to allow for adjustments in the intensity of the light emanating from the illumination source.

Description of the Related Art

The use of large shade structures specifically including, but not limited to, large umbrellas of the type typically used outdoors, has become commonplace due. This is due to their ability to provide shade and other protection from ambient weather conditions, and for certain designs of outdoor umbrellas, to their aesthetic appearance.

The growing popularity of such outdoor shade structures has led to competition among manufacturers and distributors, which in turn, has resulted in certain structural and functional improvements, as well as design features, for such shade structures in order to obtain a commercial advantage. Typically, the basic structural and operational characteristics of large outdoor umbrella types of shade structures include a support mast, which can be, but does not have to be a center pole, disposed in supporting relation to at least one umbrella canopy, which is capable of being selectively disposed between open and closed orientations. However, some of the modern-day large outdoor umbrellas are now provided with a number of auxiliary features in order to make them more attractive to the consuming public.

By way of example, some large outdoor umbrellas and/or other shade structures now include auxiliary lighting, which is typically structured and disposed to illuminate areas beneath the umbrella canopy or in close proximity thereto. Such lighting is useful for lighting one or more tables situated under the umbrella where a person may be seated for dining, reading, etc. However, and as set forth above, some large outdoor umbrellas are now designed to have attractive and appealing visual features and to provide unique aesthetic appearances, in addition to having various operational and function characteristics. One drawback associated with conventional or known lighting systems associated with outdoor umbrellas and shade structures is that they are not necessarily operative to enhance the appearance of the umbrella or shade structure itself, but rather, are primarily intended to illuminate the immediately adjacent areas commonly occupied by one or more individuals beneath the shade structure.

Therefore, there remains a need in the art for providing additional illumination capabilities to large outdoor umbrellas and a variety of different shade structures. If any such type of addition to shade structures were developed, it would preferable be primarily, if not exclusively, operative to highlight one or more structural features of the shade structure itself. By way of example, if any such illumination assembly were developed, it should provide illumination that is able to be directed into and/or onto the umbrella canopy, and more specifically, the interior portions or surface of the canopy. This, in turn, would result in a significant enhancement of the visual appearance of the umbrella canopy, particularly at night or under other darkened conditions. Further, and dependent on the material from which the canopy is formed, the enhanced illumination thereof would be readily observable from those in the immediate surrounding area as well as those located greater distance therefrom. If any such illumination assembly were developed, it should also be capable of being easily operated, with abilities to select a desired level of brightness.

SUMMARY OF THE INVENTION

The present invention is directed to an indirect lighting assembly for a shade structure specifically including, but not limited to, a large outdoor umbrella of the type used at a restaurant, eating or drinking establishment, or in a variety of other recreational areas. However, the indirect lighting assembly of the present invention may be used with different shade structures, such as cabanas, cantilevered umbrellas and multiple and/or combined canopied umbrella structures, etc.

More specifically, the indirect lighting assembly of the present invention comprises a lighting assembly including an illumination source preferably mounted on a hub or like structure associated with the support and movement of the umbrella canopy between open and closed orientations. The hub or like structure is typically movable along the length of a support mast and/or center pole. In at least one embodiment, however, the hub is movable with a support arm and/or support rib associated with the canopy of a cantilevered umbrella. In each of a number of possible exemplary embodiments, the hub is moved or displaced as the corresponding canopy of the shade structure is opened or closed. Therefore, the disposition of the lighting assembly on the hub and its movement therewith will facilitate the proper position and orientation thereof, when the canopy is in an open orientation.

The indirect lighting assembly of the present invention further includes a power input connected to the illumination source, whether directly or indirectly. In one or more embodiments, the power input may receive electric energy from a conventional alternative current (AC) power source whether 110 volts or 220 volts. Thus, when a large outdoor umbrella is in use in a location that has a traditional AC power supply available, an electrical cord associated therewith can simply be plugged-in to that power source for allowing illumination of the lighting assembly to occur, when activated. In at least one alternative embodiment, the power input may be connected to solar power source operative to convert solar energy into electrical energy.

In addition, the indirect lighting assembly of the present invention further includes a control assembly that is operatively connected to the illumination source, in current regulating relation thereto. In at least one preferred embodiment, the control assembly includes touch control switching operative to regulate current flow to the illumination source. The touch control switching may include and/or be at least partially defined by a touch control member that is sufficiently conductive so as to be sensitive to the touch of a human hand or finger. The touch control member may also be mounted on the hub of the shade structure and movable therewith along with the lighting assembly and illumination source. For purposes of safety and convenience, the touch control member, being movable with the hub, is operatively disposed in an overhead, access restricting position when the canopy is an open orientation. As used herein the term "overhead position" or its equivalent is meant to be descriptive of a location generally above the torso and/or head of an adult, thereby restricting access to the touch control member either inadvertently or by a child.

Additional features of the control assembly, in an embodiment comprising the touch control switching, is the inclusion of a dimmer function operative to regulate the volume of the current flow to the illumination source. As a result, the brightness of the illumination generated by the illumination source and directed onto the interior of the canopy, when in an open position, may be selectively varied. In cooperation therewith, the touch control switching may include an on-off function, wherein the touch control member may be engaged, through touch, to establish or interrupt current flow to the illumination source, thereby causing its activation or deactivation.

Other operative characteristics of the control assembly, which may or may not be associated with the touch control switching, includes an off-switch operative to deactivate the illumination source automatically, upon movement of the canopy into the closed position.

Yet additional structural features of the indirect lighting assembly include the illumination source comprising an array of light emitting diodes (LED). The LED array may comprise a plurality of low voltage (e.g., 12 volts) LED lights, which may vary in number, but which are collectively interconnected to the hub so as to be movable therewith, as set forth above. Interconnection of the LED array to the hub is facilitated by an illumination mount attached directly to the hub in supporting, connected relation to the LED array. Further, the illumination mount may include control circuitry associated with the aforementioned control assembly. Such control circuitry is appropriately structured and operative to facilitate performance of the dimmer function, on-off function; power input, as well as an electrical interconnection between the touch control switching and the illumination source, etc.

For purposes of facilitating installation of the lighting assembly as well as the operational efficiency of the canopy and hub, the illumination source and illumination mount may have an at least partially annular configuration. Such a configuration will preferably be defined as a "horseshoe" shaped configuration, but other shapes are also possible. The preferred horseshoe shaped configuration is at least partially defined by an open segment in the curvilinear length of the illumination source and illumination mount, disposed between spaced apart free ends of the illumination mount. The provision of the open segment facilitates installation and adaptation of the indirect lighting assembly to the canopy supporting structure as well as the hub itself. Moreover, the open segment is disposed and dimensioned to eliminate any undesirable engagement or interference between such support structure of the umbrella and the illumination source and/or illumination mount, during opening and closing of the canopy. For example, the horseshoe shaped configuration and the included open segment may be advantageous when the indirect lighting assembly of the present invention is mounted on a cantilevered umbrella, wherein the canopy, hub and corresponding support structure are cantilevered outwardly from a support mast.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 1-B is a close up view in part of the associated structure for an umbrella canopy illustrated in FIG. 1-A, as well as of the hub and indirect lighting assembly, and illustrating a hand about to touch the latter to activate or de-activate the illumination source associated therewith.

FIG. 1-C is a close up view in part of the support mast associated with the shade structure shown in FIG. 1-A, and illustrating a power source and electrical cord disposed at a lower end thereof.

FIG. 1-D is a schematic representation of an indirect lighting assembly of the present invention operable to direct illumination from a hub of a shade structure onto the interior of a canopy thereof, with the shade structure shown being an umbrella having a central pole.

FIG. 5-B is a partial perspective view of the indirect lighting assembly, hub, and the associated structure for an umbrella canopy illustrated in FIG. 1-A, and illustrating a closed orientation.

Like reference numerals refer to like parts throughout the several views of the drawings.

DETAILED DESCRIPTION OF THE PREFERRED EMBODIMENT

Figure 1D:
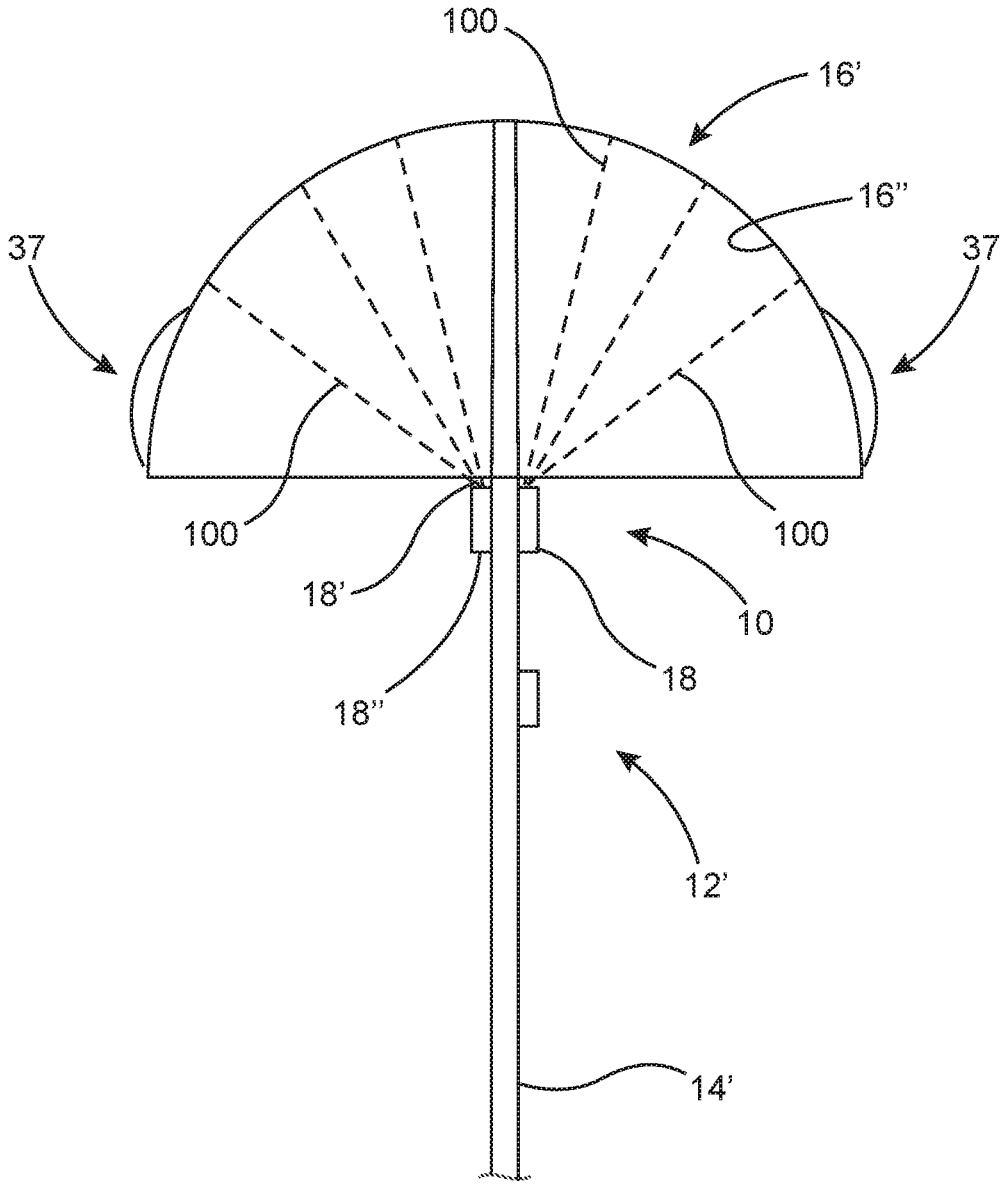
FIG. 1-A is an illustration of a shade structure in the form of a cantilever styled umbrella having a support mast and associated structure for an umbrella canopy, including a hub and an indirect lighting assembly according to the present invention, and illustrating an open orientation.

As represented in the accompanying Figures, the present invention is directed to an indirect lighting assembly generally indicated as 10 for use on a shade structure 12 of the type schematically represented in at least FIGS. 1-A and 1-D. The indirect lighting assembly 10 of the present invention may be used with a large outdoor umbrella having a support mast, such as a cantilever type of umbrella shown in FIG. 1-A, or on one having a center support pole such as shown in FIG. 1-D. It is emphasized, however, that the structural and operational versatility of the indirect lighting assembly 10 facilitates its use on a variety of different shade structures including cabanas, a multiple cantilevered umbrella structure or other multi-canopied umbrellas, umbrellas with multiple masts, as well as other shade structure designs.

However, for purposes of clarity, the structural and operative features of the indirect lighting assembly 10 will be explained and described with reference to the umbrella shade structure 12 and 12' as also schematically represented in FIGS. 1-A and 1-D. With initial reference thereto, the shade structure comprising a large outdoor umbrella 12 includes a single mast 14 or center pole 14' and a canopy generally indicated as 16 or 16'. The umbrella 12 also includes a hub 18 which is movably interconnected to a canopy support structure typically including plurality of struts and ribs, such as are partially shown in FIG. 5-A, which adjustably support the canopy frame 16 on the support mast 14. Again, for purposes of clarity the canopy 16 is represented in FIGS. 1-A and 1-D in its open orientation, whereas in FIG. 5-B, there is shown a partial view of a closed orientation.

Figure 2:
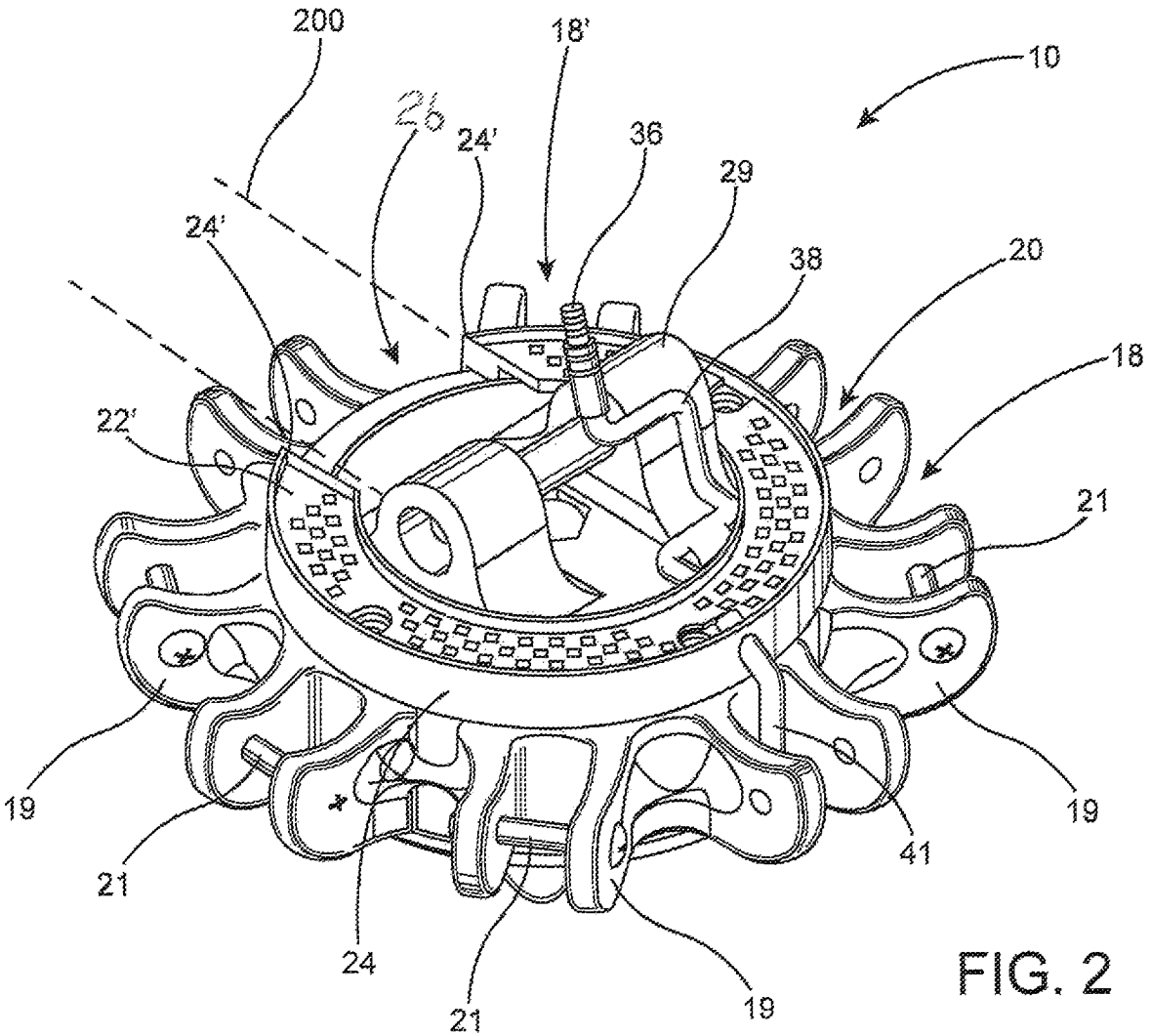
FIG. 2 is a perspective view in partial phantom of the indirect lighting assembly of the present invention mounted on a hub of a shade structure, of the type represented in FIG. 1-A.
Figure 4:
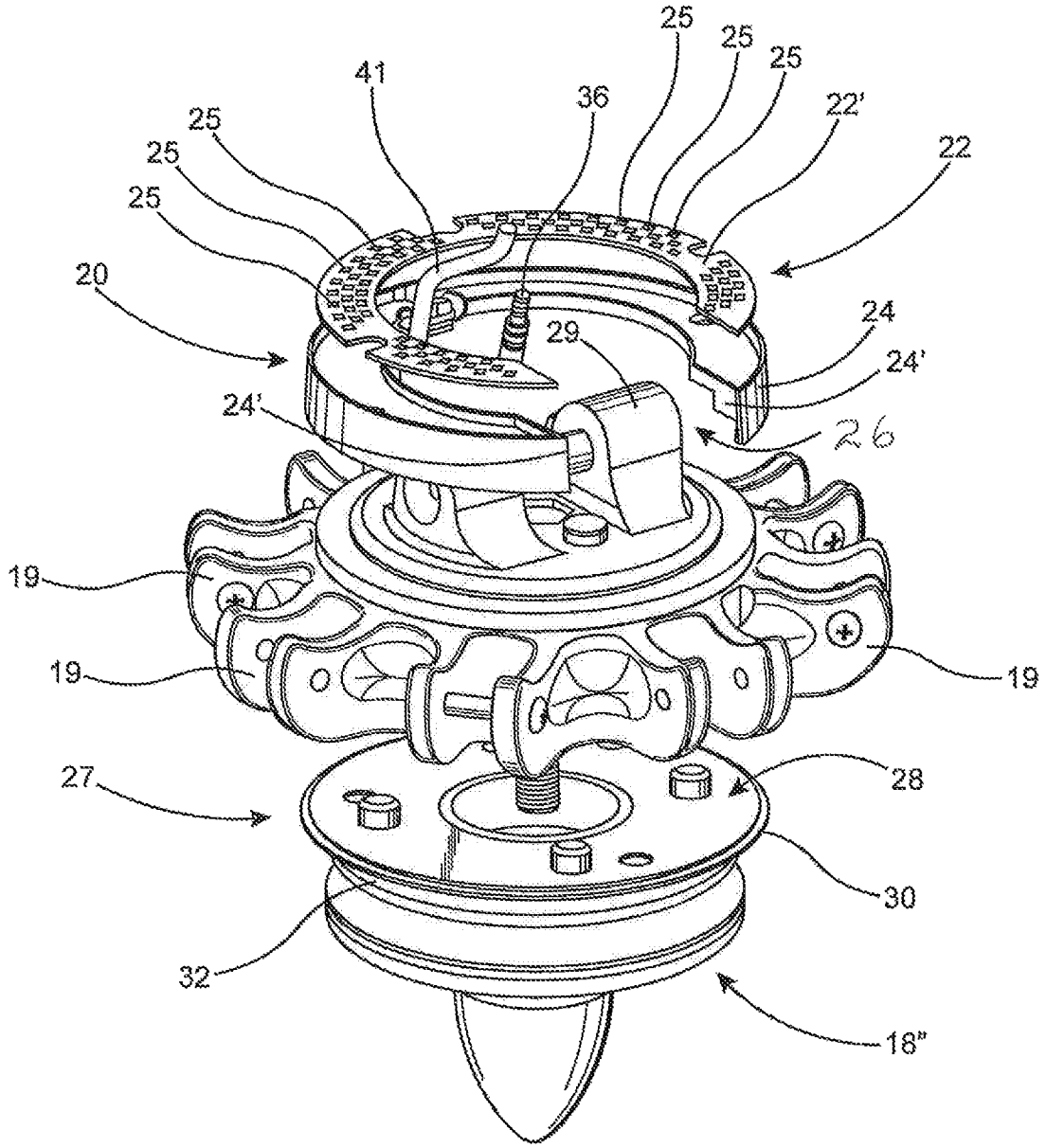
FIG. 4 is a perspective view in exploded form of the indirect lighting assembly of the present invention and hub of a shade assembly, of the type represented in FIGS. 2 and 3.
Figure 5A:
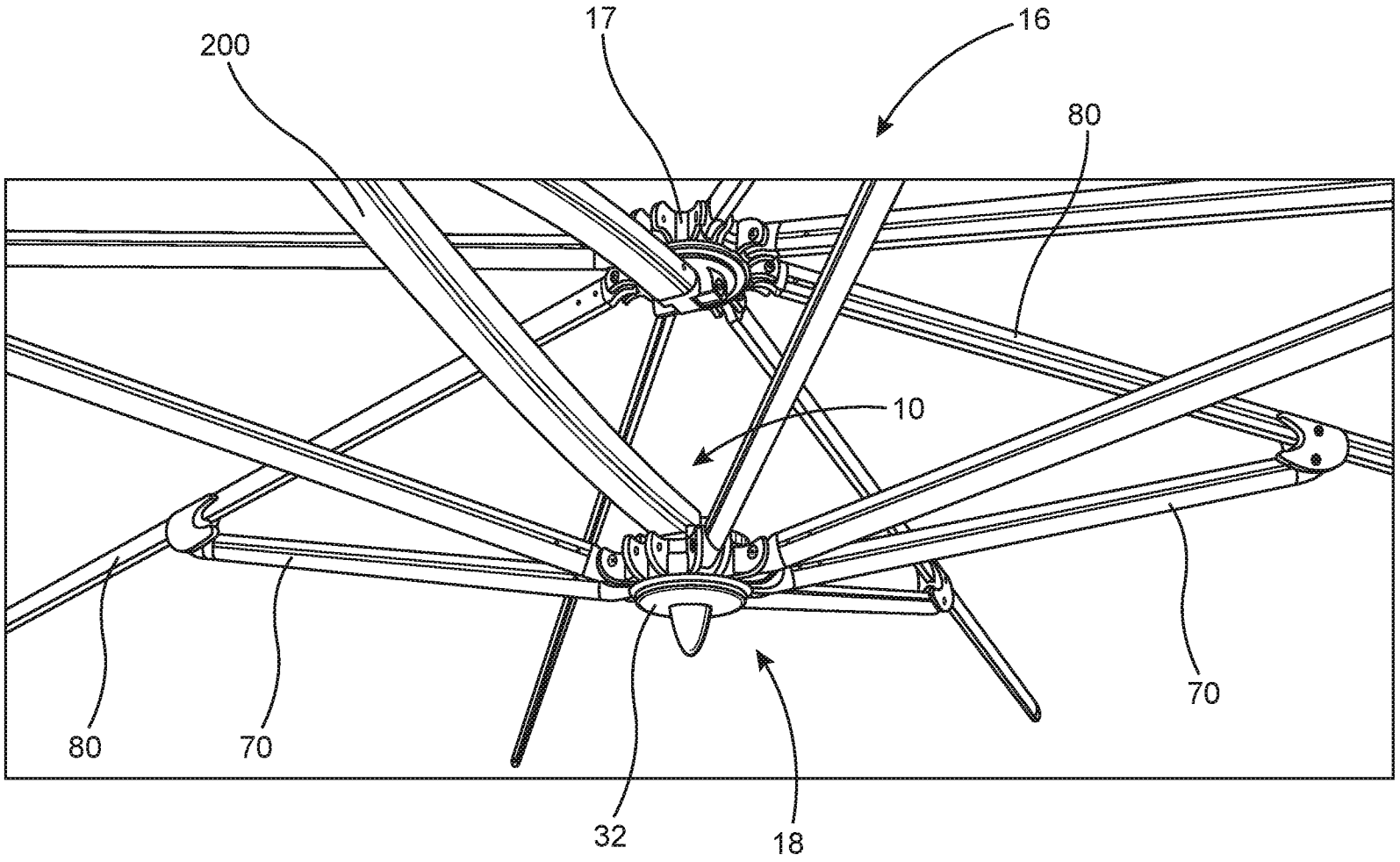
FIG. 5-A is also a close up view similar to that shown in FIG. 1-A, but illustrating more of the associated structure for an umbrella canopy, as well as of the hub and indirect lighting assembly, and a hand about to touch the latter.
Figure 5B:
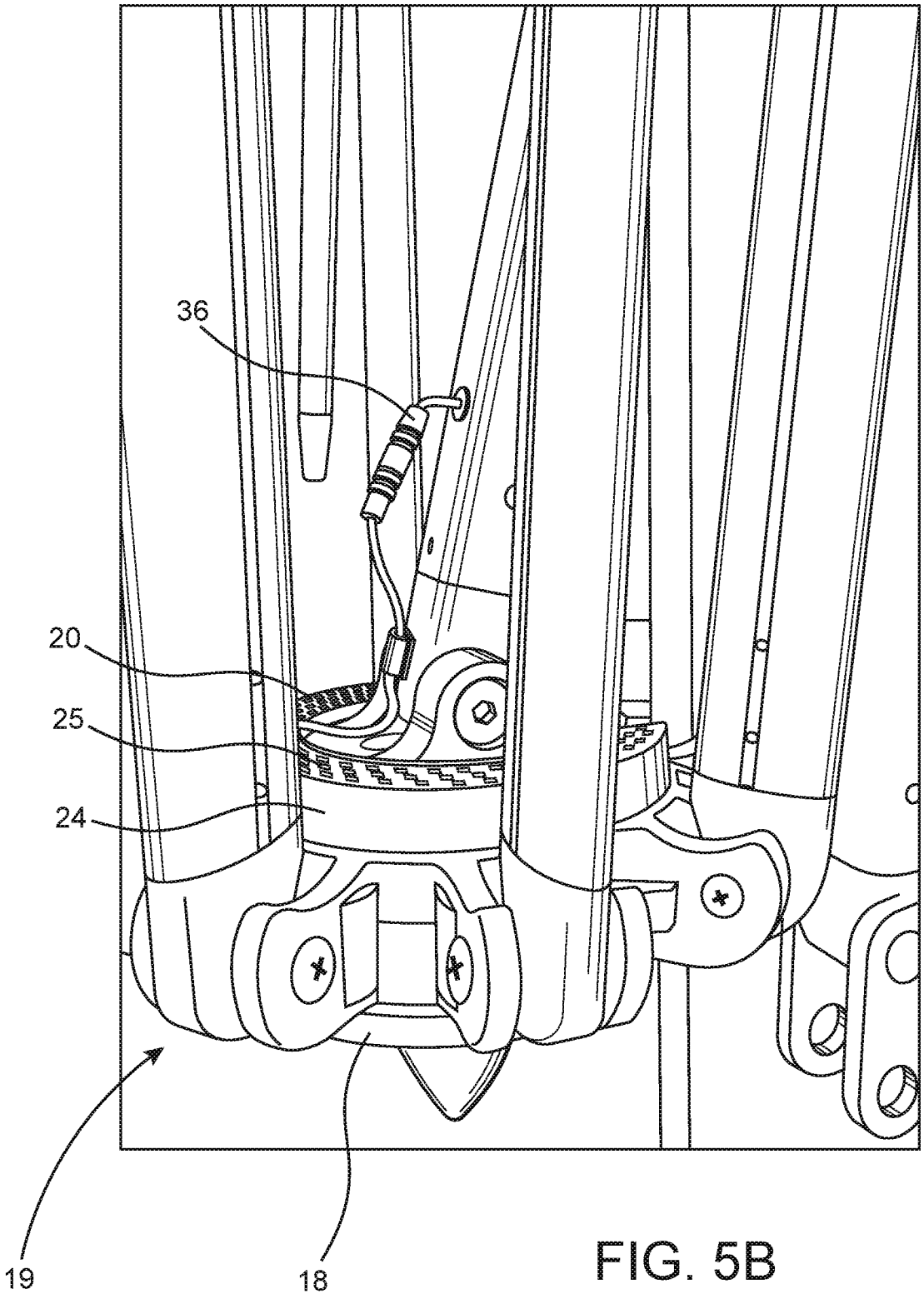

As shown in FIG. 1-A and partially in FIG. 5-A, the shade structure in the form of a large, outdoor, cantilever style umbrella 12 utilizes structure associated with the canopy frame 16, such as rib members 70 and strut members 80, as well as at least one support arm 200, which are movably interconnected between at least one hub 18, and preferably a pair of hubs such as lower hub 18 and upper hub 17, to form the canopy frame 16, and which collectively facilitate the selective positioning of the canopy frame 16 between an open and closed orientation. Further, as represented in FIGS. 2 and 4, the hub 18 is structurally adapted for movable interconnection with a plurality of rib members 70 of the canopy frame or support structure 16 and includes a plurality of connecting sockets 19, each of which include connecting pins or like structures 21 (not shown), to which the plurality of ribs members and strut members may be pivotally attached. For details regarding such structures, reference may be made to U.S. Pat. Nos. 6,314,976 and 7,318,444 which are owned by the Applicant and/or Assignee, and incorporated herein by reference in their entireties.

Figure 3:
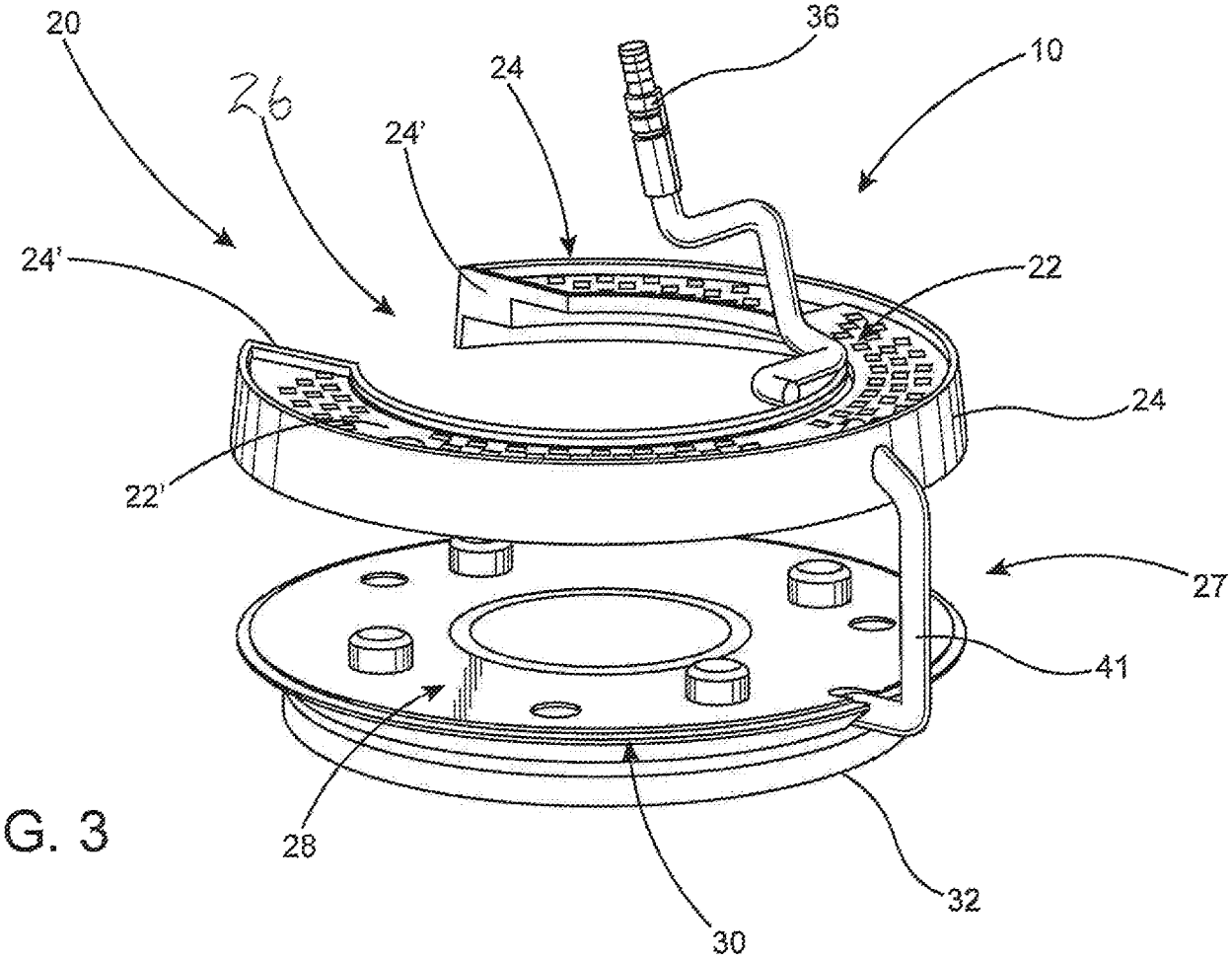
FIG. 3 is a detailed perspective view of the indirect lighting assembly of the present invention disassembled from the hub of the shade structure of the type represented in FIGS. 1A, 1B and Figure and 2.

With primary reference now to FIGS. 3 and 4, structural components of the indirect lighting assembly 10 include an illumination assembly generally indicated as 20 including an illumination source 22 disposed and/or connected in supported relation on an illumination mount 24. In at least one preferred embodiment, the illumination source 22 may comprise an array of light emitting diodes (LED) 25 disposed on and extending along at least a majority of an LED board or support structure 22'. The array of LED 25 lights may comprise a plurality of low voltage lights, such as 12 volts, to provide for safer operating conditions.

As also represented in FIG. 3, the indirect lighting assembly 10 includes a control assembly 27 which in at least one embodiment, comprises touch control switching, generally indicated as 28. The control assembly 27 and the touch control switching 28 further comprise a touch control member or plate 30 and interconnected casing 32. While not shown for purposes of clarity, operative circuitry associated with the control assembly 27 and touch control switching 28 is preferably disposed within the casing 32. The operative circuitry may vary in structure, integrated electronic components and operative characteristics, but is operative to regulate the flow of current to the illumination source 22 and led array 25.

Although not specifically represented, such operative circuitry of the control assembly 27 and the touch control switching 28 may include one or more charge storing capacitor components and selectively operable conductors, etc. As such, the operative circuitry serves to activate, deactivate and regulate current flow from an incoming power source, via the power input 36 and conductor 41, to the lighting assembly 20, specifically including the illumination source 22 and LED array 25. In addition, the aforementioned operative circuitry of the control assembly 27 and touch control switching 28 is sensitive to the physical touch of a human hand, finger, etc. Accordingly, and as shown in FIGS. 1-A and 5-A, an individual may activate, deactivate and select operative characteristics of the indirect lighting assembly 10 through a physical touching of the touch control switching 28 and more specifically, the touch control member 30 and/or conductively interconnected casing 32, as explained in greater detail hereinafter, which may even include a decorative finial, as shown.

Additional operative characteristics of the control assembly 27, and specifically including the touch control switching 28, is the inclusion of a dimmer function operative to regulate the volume of the current flow to the illumination source 22. As a result, the brightness of the illumination 100, schematically represented in FIG. 1-D, generated by the illumination source 22 and/or LED array 25 and directed onto the interior 16" of the canopy 16, when in an open orientation, may be selectively varied. In cooperation therewith, the touch control switching 28 may include an on-off function, wherein the touch control member 30 may be engaged, by physically touching, to establish or interrupt current flow to the illumination source 22, thereby causing its activation or deactivation.

Other operative characteristics of the control assembly 27, which may or may not be associated with the touch control switching 28, include an off-switch 17 operative to deactivate the illumination source 22 and LED array 25 automatically, upon movement of the canopy into the closed position. More specifically, when the canopy 16 is disposed in a collapsed or closed orientation such as is partially shown in FIG. 5-B, the hub 18 will move downwardly along the support mast 14 or a center pole 14'. In such downward movement, the hub 18 will engage and "trip" a strategically located off-switch 17. As a result, disposition of the canopy in the closed orientation will "automatically" interrupt current flow to the LED array 25 causing a deactivation of the illumination source 22.

As indicated above with reference to FIGS. 3 and 4, additional structural features of the indirect lighting assembly 10 include the power input 36 interconnected to an incoming electrical power source, such as shown in FIG. 1-A as a conventional AC current with traditionally either 110 or 220 volts from an electrical cord 30 structured to be plugged-in to such power source. In an alternative embodiment, the shade structure and/or umbrella 12 may also include and/or be directly associated with a source of solar power 37 operative to convert solar energy into electrical energy. For purposes of clarity, an appropriate solar power source 37 is schematically represented in FIG. 1-D as being mounted on an exposed portion of the fabric or canopy associated with canopy frame 16 or other portions of the shade structure 12. As illustrated in FIG. 2, the power input 36 is connected by appropriate conductors 38 to the lighting assembly 20 and more specifically, to the illumination source 22 and LED array 25. In addition, conductor(s) 41 serve to electrically interconnect the illumination source 22 to the control assembly 27 and its included touch control switching 28.

As described herein, the indirect lighting assembly 10 is structured to be used in combination with any one of a plurality of different shade structures 12 so as to create an indirect lighting effect. Therefore, as practically applied, the indirect lighting assembly 10 is mounted on the hub 18 of the shade structure 12, as clearly represented in FIGS. 2 and 4. In more specific terms, the lighting assembly 20, including the illumination source 22 and LED array 25, are mounted on an upper or inner end 18' of the hub 18 as shown in FIGS. 2-4 and 5-B. As used herein, the upper or inner end 18' of the hub 18 is the end of the hub 18 that is directed or faces inwardly or upwardly towards the interior surfaces 16" of the canopy 16. As should be apparent, the inner or upper end 18' is oppositely disposed to the outer or lower end 18" of the hub, shown in FIGS. 1-D and 4, which is directed or faces downwardly towards a surface on which the shade structure 12 is supported.

Therefore, when operatively positioned in the intended manner, the illumination assembly 20 and specifically, the illumination source 22 and LED array 25 is mounted on the upper or inner end 18' of the hub 18 and in such an orientation, will serve to direct illumination 100, schematically represented as 100 in FIG. 1-D, from the hub 18 into the interior and/or on interior surfaces 16" of the canopy 16. Being mounted on the hub 18, the illumination assembly 20, as well as the control assembly 27, both concurrently move with the hub 18 relative to a support mast 14, center pole 14' or like structure, when the canopy 16 or 16' is disposed between an open orientation as shown in FIGS. 1-A, 1-D and 5-A, and a closed or collapsed orientation, as is partially shown in FIG. 5-B.

It is again emphasized that the indirect lighting assembly 10 may be utilized with different types and sizes of shade structures 12. Therefore, at least some of the different type of shade structures may not have a single hub 18 operative to move along a support mast 14 or center pole 14' during the opening and closing of the canopy 16. However, in many different types of shade structures, the indirect lighting assembly 10 will be mounted on a similar, movable hub or substantially equivalent structure which is moved or displaced relative to and during an opening and closing of a corresponding canopy. In each such variable instance, the illumination source 22 will be disposed to direct illumination 100 into the interior or on the interior surface 16" of a correspondingly positioned canopy 16.

In order to further facilitate the adaptation of the indirect lighting assembly 10 to different shade structures, the illumination assembly 20, and more specifically, the illumination source 22, LED array 25 and illumination mount 24 preferably comprise an at least partially annular configuration. This at least partially annular configuration facilitates the disposition of the illumination assembly 20 in at least partially surrounding relation to a portion of the hub 18, such as a connecting portion 29 of the hub 18, as shown in FIGS. 2 and 5-B. Further, and as has been described, the indirect lighting assembly 10 may be mounted on a hub 18 which is part of a cantilevered umbrella or like shade structure such as shown in FIG. 1-A, and as such, may include a supporting arm or supporting rib 200 serving to movably position and/or support the hub in a cantilevered fashion, as well as the indirect lighting assembly 10 thereon, during the opening and closing of the canopy 16.

Therefore, and as perhaps best shown in FIGS. 2 and 3, the at least partially, annular configuration of the lighting assembly 20 may be further defined as a substantially "horseshoe" shaped configuration. In turn, this horseshoe configuration is at least partially defined by spaced-apart, free ends 24' of the illumination mount 24 and an open segment 26 disposed therebetween. As further represented, the open segment 26 is disposed along the curvilinear length of the illumination mount 24. Therefore, when the indirect lighting assembly 10 is mounted on a hub 18 of the type associated with a cantilevered umbrella and/or canopy, the open segment 26 is disposed and dimensioned to removably receive the supporting arm or rib 200, as schematically represented FIG. 2, of the cantilevered umbrella. Accordingly, the structural adaptation of the illumination assembly 20, illumination mount 24 and illumination source 22 to include the open segment 26 eliminates any interruptive, abutting engagement and/or physical interference between the movement of the supporting arm or rib 200 and the indirect lighting assembly 10.

The compact and efficient structuring of the indirect lighting assembly 10 is further demonstrated by virtue of the placement of the control assembly 27, specifically including the touch control switching 28, adjacent to or in engagement with the lower, outer end 18" of the hub 18, as perhaps best represented in FIG. 4. Accordingly, due to the fact that the indirect lighting assembly 10 is movable with the hub 18, the indirect lighting assembly 10 and specifically, the control assembly 27 and touch control switching 28 will be disposed at a raised distance from the surface on which the shade structure 12 is disposed, when the canopy 16 is in the open orientation.

As a result, the touch control switching 28, touch control member 30 and circuitry containing casing 32 will be disposed at a predetermined raised distance above the supporting surface of the shade structure 12. Therefore, the touch control switching 28 can be accurately described as being disposed in an access restrictive position, such as being in an "overhead" position above an average size adult. This will restrict inadvertent access and access by a child to the touch control switching 28.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An indirect lighting assembly for a shade structure comprising:

a lighting assembly mounted on a hub of the shade structure and movable therewith concurrent to opening and closing of a canopy of the shade structure, said lighting assembly including an illumination source connected to an inner end of said hub and disposed to direct illumination upwardly from said hub onto an interior of the canopy, a power input connected to said lighting assembly and structured to direct electrical current to said illumination source, and a control assembly operatively connected to said lighting assembly in current regulating relation to said illumination source, said control assembly comprising touvh control switching operative to regulate current flow to said illumination source.

2. The indirect lighting assembly as recited in claim 1 wherein said touch control switching includes a dimmer function operative to regulate the volume of said current flow to said illumination source and brightness of said directed illumination.

3. The indirect lighting assembly as recited in claim 2 wherein said touch control switching includes an on-off function operative to interrupt said current flow to said illumination source.

4. The indirect lighting assembly as recited in claim 3 wherein said touch control switching is connected to said hub and movable therewith between open and closed orientations of the canopy.

5. The indirect lighting assembly as recited in claim 1 wherein said touch control switching is connected to said hub and movable therewith between open and closed orientations of the canopy.

6. The indirect lighting assembly as recited in claim 1 wherein said touch control switching includes a touch control member connected to said hub and movable therewith into an overhead, access restricting position concurrent to disposition of the canopy in an open orientation.

7. The indirect lighting assembly as recited in claim 1 wherein said illumination source comprises an LED array disposed on said hub and movable therewith, said LED array oriented to direct illumination outwardly from said hub onto an interior of the canopy.

8. The indirect lighting assembly as recited in claim 1 wherein said lighting assembly further comprises an illumination mount connected to said hub.

9. The indirect lighting assembly as recited in claim 8 wherein said lighting assembly and said illumination mount comprise an at least partially annular configuration collectively disposed on said hub in at least partially surrounding relation to a canopy supporting stanchion.

10. The indirect lighting assembly as recited in claim 9 wherein said at least partially annular configuration comprises a substantially horseshoe configuration including spaced apart free ends of the illumination mount defining an open segment disposed along a curvilinear length of said illumination mount.

11. An indirect lighting assembly as recited in claim 10 wherein said open segment is disposed and dimensioned removably to receive a canopy support member therein during opening and closing of the canopy.

12. An indirect lighting assembly as recited in claim 8 wherein said lighting assembly and said illumination mount collectively comprise a substantially horseshoe configuration at least partially defined by an open segment disposed along a curvilinear length of said illumination mount.

13. An indirect lighting assembly as recited in claim 12 wherein said open segment is dimensioned to removably receive a canopy support member therein during opening and closing of the canopy.

14. An indirect lighting assembly as recited in claim 12 wherein said substantially horseshoe configuration is disposed in at least partially surrounding relation to a canopy supporting stanchion.

15. An indirect lighting assembly as recited in claim 1 wherein said power input is connected to a solar power source.

16. An indirect lighting assembly for a shade structure comprising:

a lighting assembly mounted on a hub of the shade structure and movable therewith concurrent to opening and closing of a canopy of the shade structure, said lighting assembly including an illumination source, said illumination source disposed on an upper end of said hub and oriented to direct illumination outwardly there from onto an interior surface of the canopy, a power input connected to said lighting assembly and structured to direct electrical current to said illumination source, a control assembly operatively connected to said lighting assembly in current regulating relation to said illumination source, and said control assembly comprising touch control switching operative to regulate current flow to said illumination source.

17. The indirect lighting assembly as recited in claim 16 wherein said lighting assembly comprises an LED array including a substantially horseshoe configuration at least partially defined by an open segment disposed along a curvilinear length of said LED array.

18. The indirect lighting assembly as recited in claim 17 wherein said open segment is disposed and dimensioned to removably receive a canopy support member therein during opening and closing of the canopy.

19. The indirect lighting assembly as recited in claim 16 wherein said touch control switching includes a touch control member connected to said hub and movable therewith into an overhead, access restricting position concurrent to disposition of the canopy in an open orientation.

20. An indirect lighting assembly for a shade structure comprising:

a lighting assembly mounted on a hub of the shade structure and movable therewith concurrent to opening and closing of a canopy of the shade structure, said lighting assembly including an illumination source connected to an inner end of said hub and disposed to direct illumination upwardly from said hub onto an interior of the canopy, said lighting assembly further comprising an illumination mount connected to said hub, said lighting assembly and said illumination mount collectively comprising a substantially horseshoe configuration at least partially defined by an open segment disposed along a curvilinear length of said illumination mount;

a power input connected to said lighting assembly and structured to direct electrical current to said illumination source, and a control assembly operatively connected to said lighting assembly in current regulating relation to said illumination source.

* * * * *